US006659007B1

(12) United States Patent
Winston

(10) Patent No.: US 6,659,007 B1
(45) Date of Patent: Dec. 9, 2003

(54) CONTINUOUS INK STAMPING SYSTEMS AND METHODS

(76) Inventor: Jeffrey M. Winston, 658 W. Shore Dr., Anacortes, WA (US) 98221

( * ) Notice: Subject to any disclaimer, the term of this patent is extended or adjusted under 35 U.S.C. 154(b) by 5 days.

(21) Appl. No.: 09/974,636

(22) Filed: Oct. 9, 2001

Related U.S. Application Data

(60) Provisional application No. 60/239,429, filed on Oct. 10, 2000.

(51) Int. Cl.[7] ..... B41K 1/38

(52) U.S. Cl. ..... 101/329; 401/218

(58) Field of Search ..... 101/327, 328, 101/329, 330, 331; 401/218

(56) References Cited

U.S. PATENT DOCUMENTS

| | | | | | |
|---|---|---|---|---|---|
| 829,230 | A | * | 8/1906 | Pope | 101/329 |
| 983,066 | A | * | 1/1911 | Kjeldaas | 101/329 |
| 1,127,806 | A | * | 2/1915 | Pells et al. | 101/329 |
| 1,576,791 | A | * | 3/1926 | Rosner | 101/328 |
| 3,167,009 | A | * | 1/1965 | Sloane | 101/329 |
| 3,465,673 | A | * | 9/1969 | Oppenheim | 101/328 |
| 4,817,526 | A | | 4/1989 | Winston | |
| 5,495,800 | A | * | 3/1996 | Weissbein et al. | 101/329 |
| 5,735,208 | A | * | 4/1998 | Hummel et al. | 101/329 |

* cited by examiner

*Primary Examiner*—Andrew H. Hirshfeld
*Assistant Examiner*—Leo T. Hinze
(74) *Attorney, Agent, or Firm*—Michael R. Schacht; Schacht Law Office, Inc.

(57) ABSTRACT

A system for forming ink impressions. The system comprises a housing, a stamping wheel, and an inking assembly comprising an inking member and a support member comprising a single part and defining at least resilient one arm portion. The housing defines a handle portion and first and bracing portions. The support member deforms to force the inking member against the stamping wheel. The support member may comprise a base portion and an engaging portion, where the engaging portion engages and supports the inking member against the stamping wheel. The at least one arm portion may be arranged between the base portion and the engaging portion.

19 Claims, 5 Drawing Sheets

CONTINUOUS INK STAMPING SYSTEMS AND METHODS

RELATED APPLICATIONS

This application claims priority of U.S. Provisional Application Ser. No. 60/239,429 filed Oct. 10, 2000.

FIELD OF THE INVENTION

The present invention relates to systems and methods for forming ink impressions on paper and, more specifically, to such systems and methods that employ a stamping wheel that is rolled along a stamping surface to form a continuous ink impression.

BACKGROUND OF THE INVENTION

The present invention relates ink stamping systems and methods in which an ink impression is formed on an impression carrying member that forms a stamping surface. The ink is applied to a stamp member on which a design is formed in bas relief. The stamp member with ink thereon is brought into contact with the carrying member such that ink is transferred to the stamping surface of the carrying member to form an ink impression in a configuration corresponding to the design on the stamp member.

The present invention is of particular importance in the formation of artistic rather than commercial ink impressions. Art stamping uses the same basic ink stamping process as commercial ink stamping but has evolved to allow much finer control over the details and quality of the resulting ink impression. The principles of the present invention also have application to commercial ink stamping, however.

Ink stamping systems for use by art stampers are designed and constructed primarily to obtain a high quality ink impression, with flexibility of use also being of importance. Considerations such as repeatability of the ink impression, ease of use, and durability of the stamping devices are of lesser importance than in the commercial ink stamping environment.

Ink pad or inking assemblies that form a continuous, repeated ink image are well-known. Such inking assemblies comprise a stamping wheel comprising a stamp member defining a cylindrical stamping surface. The design formed in bas relief on the stamp member is formed on the outer surface of the stamp member. The stamp member is mounted on a handle or housing assembly such that the handle can be grasped to roll the stamp member along an ink pad and then along an inking surface to form the desired ink impression on the inking surface. In some continuous inking assemblies, the ink pad is also mounted to the handle such that ink is continuously applied to the outer member of the stamp member as the stamp member rolls along the inking surface.

One such a continuous inking assembly is disclosed in U.S. Pat. No. 4,817,526 for a Rolling Contact Printer With Retractable Inking Wheel. The '526 patent discloses a printing device comprising a print or stamping wheel and an inking assembly. The inking assembly comprises an ink housing and an inking roller that is moveable between a forward position where the inking roller is in contact with the print wheel and a retracted position where the inking roller is spaced from the print wheel. A separate spring is mounted in the housing. The spring urges the inking roller toward the first forward position. A releasable retaining structure is positioned on the ink housing to hold the inking assembly in the retracted position.

The structure disclosed in the '526 patent is relatively complex and expensive to manufacture, and the need exists for systems and methods that create continuously repeating ink impressions that are less expensive to manufacture.

SUMMARY OF THE INVENTION

The present invention may be embodied as a system for forming ink impressions. The system comprises a housing, a stamping wheel, and an inking assembly comprising an inking member and a support member. The housing defines a handle portion and first and bracing portions. The stamping wheel is rotatably supported by the wheel retaining portion of the housing. The inking member is supported by the support member and the support member is in turn supported by the bracing portion of the housing such that the support member deforms to force the inking member against the stamping wheel. The inking member applies ink to the stamping wheel. When the stamping wheel is brought into contact with the stamping surface and the housing is displaced relative to the sheet of material, ink is deposited on the stamping surface to form the ink impression. The support member may comprise a base portion and an engaging portion, where the engaging portion engages and supports the inking member against the stamping wheel. The support member may further comprise at least one arm portion arranged between the base portion and the engaging portion.

The present invention may also be embodied as a method of forming ink impressions on a stamping surface of a sheet of material. A stamping wheel is supported on a housing. An inking assembly is formed by mounting an inking member on a support member. The inking assembly is mounted on the housing. The support member is compressed to force the inking member against the stamping wheel such that the inking member applies ink to the stamping wheel. The stamping wheel is brought into contact with the stamping surface. The housing is displaced relative to the sheet of material to roll the stamping wheel along, and thereby deposit ink onto, the stamping surface to form the ink impression.

DETAILED DESCRIPTION OF THE PREFERRED EMBODIMENTS

Figure 1:
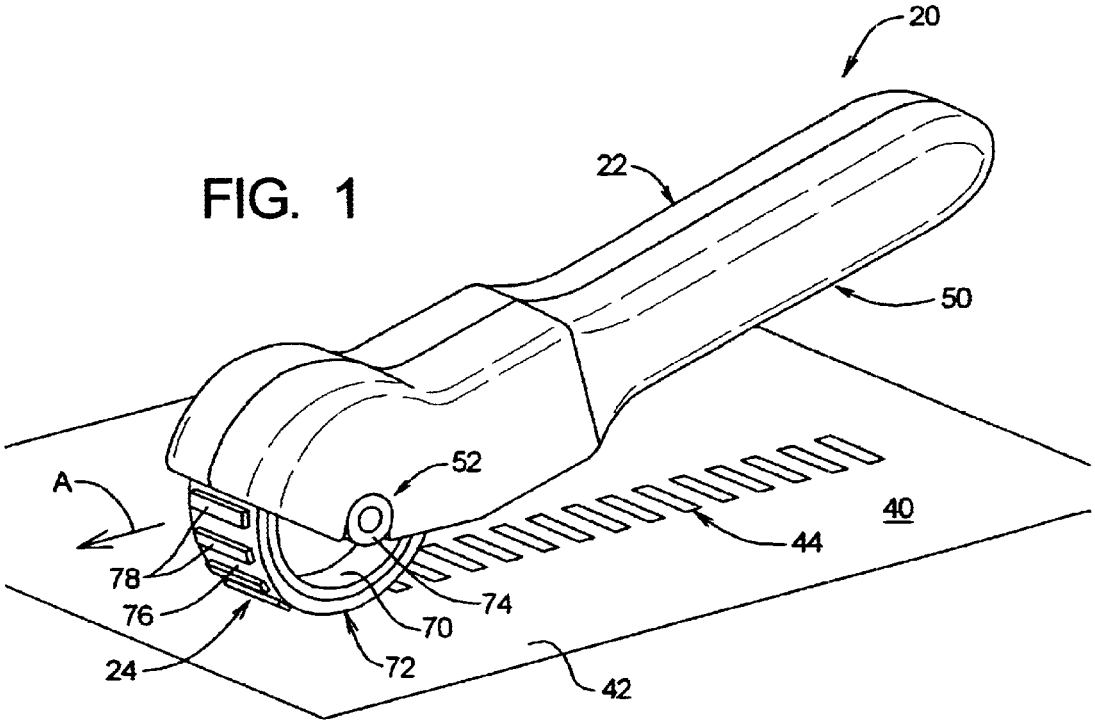
FIG. 1 is perspective view depicting an inking assembly of the present invention.

Referring initially to FIG. 1, depicted at 20 therein is an stamping system constructed in accordance with, and embodying, the principles of the present invention. As perhaps best shown in FIG. 3, the stamping system 20 comprises a housing 22, a stamp wheel 24, and an inking assembly 26. The inking assembly 26 comprises an inking member 30 and a support member 32.

The stamp wheel 24 is rotatably supported by the housing 22. The inking member 30 is impregnated with ink, and the inking assembly 26 mounted within the housing 22 such that the support member 32 forces the inking member 30 against the stamp wheel 24. In the exemplary system 20, the inking member 30 is a cylindrical ink-impregnated member defining an inking surface 34 and axle cavities 36. The present invention may be embodied using other shapes and configurations of inking members.

Referring back now to FIG. 1, as the housing 22 is moved in the direction of arrow A along a printing surface 40 formed by an image carrying member 42, the inking member 30 applies ink to the stamp wheel 24, which in turn transfers the ink to the printing surface 40 to form an ink impression 44.

The exemplary housing 22 comprises a handle portion 50, a stamp wheel mounting portion 52, a bracing portion 54, and a guide portion 56. The exemplary housing 22 comprises first and second housing members 58*a* and 58*b* that are joined together, either permanently or with a temporary snap fit. The handle portion 50 of the housing 22 allows a user of the system 20 to grasp and manipulate the stamping system 20.

Figure 2:
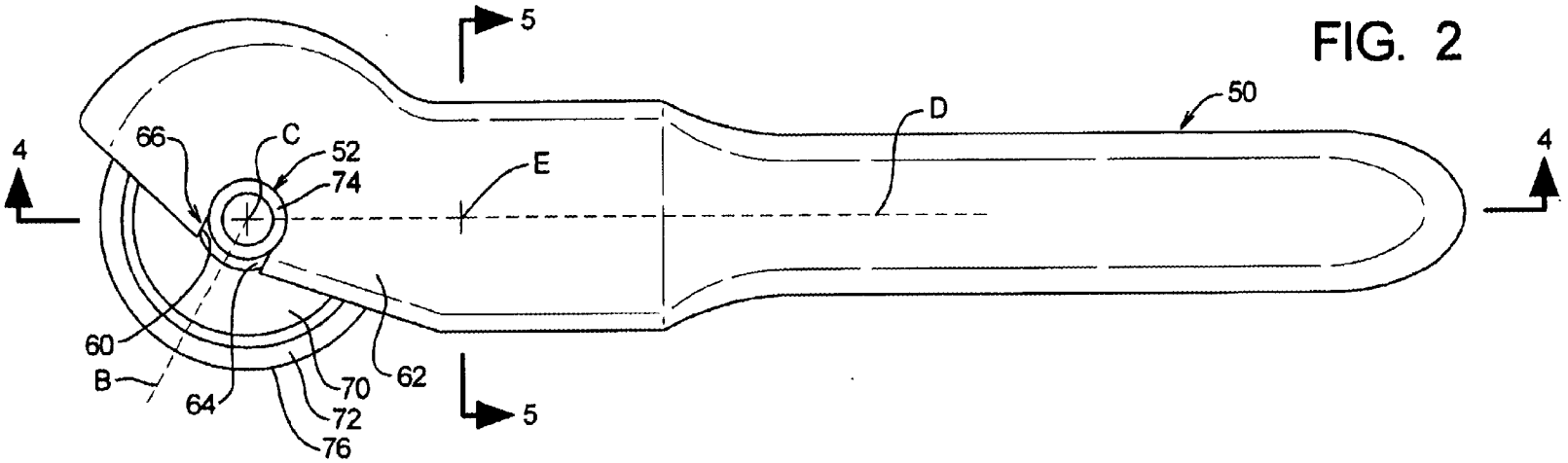
FIG. 2 is a side elevation view of the inking assembly of FIG. 1.
Figure 3:
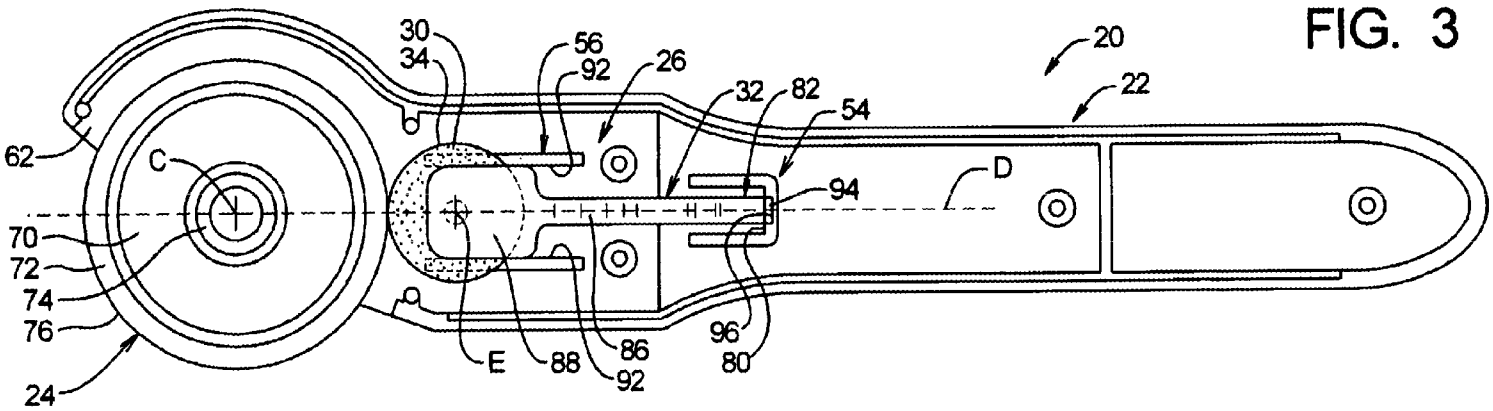
FIG. 3 is a side elevation view of the inking assembly of FIG. 1 with half of a housing assembly removed.
Figure 4:
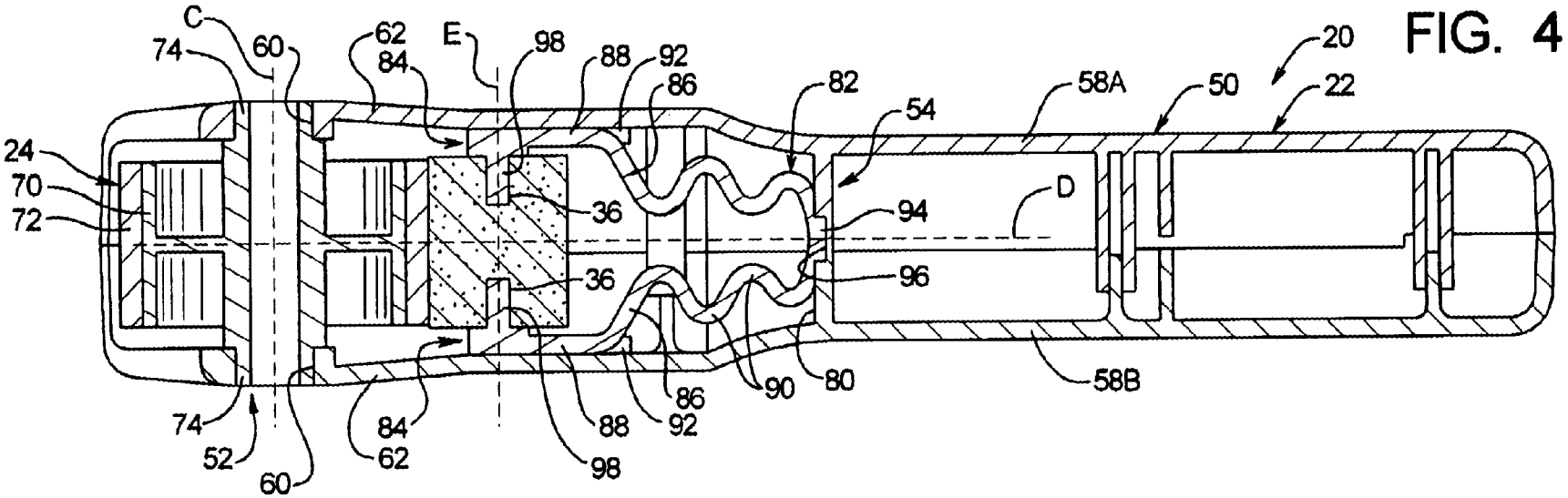
FIG. 4 is a section view of the inking assembly of FIG. 1 taken along lines 4—4 in FIG. 2.
Figure 5:
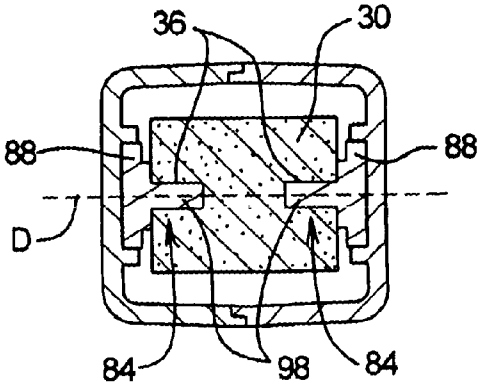
FIG. 5 is a section view of the inking assembly of FIG. 1 taken along lines 5—5 in FIG. 2.

Referring now to FIGS. 2–4, the relationship between the housing 22 and stamp wheel 24 will be described. FIGS. 2 and 4 show that the stamp wheel mounting portion 52 of the housing 22 comprises first and second bearing surfaces 60 formed in side walls 62 of the housing 22. The bearing surfaces 60 define slots 64 having narrowed throat portions 66. The parallel slots 62 define slot paths B.

FIGS. 2–4 show that the stamp wheel 24 is an assembly comprising a hub member 70 and a stamp member 72. Axle projections 74 extend from the hub member 70. The stamp member 72 is generally conventional and comprises a stamp surface 76. The exemplary hub member 70 and stamp member 72 are cylindrical; the stamp surface 76 is thus also cylindrical and has image projections 78 formed thereon that define a desired image in bas relief.

The axle projections 70 engage the bearing surfaces 60 to form a printing wheel attachment system that detachably attaches the stamp wheel 24 to the housing 24. In particular, the axle projections 70 are received within the slots 64 such that the stamp wheel 24 may rotate about a printing wheel axis C (FIG. 4). However, the axle projections 70 snap into the slots 64 along the slot paths B past the throat portions 66; the throat portions 66 thus prevent inadvertent removal of the stamp wheel 24 from the slots 64. The user can, however, overcome the snap fit formed by the throat portions 66 with deliberate application of manual force out of the slots 64 along the slot paths B to allow removal and replacement of the stamp wheel 24.

When ink is applied to the image projections 78 and the stamp surface 76 is rolled across the printing surface 40, the desired image is represented by the ink impression 44. If a different ink impression is required, the stamp wheel 24 is simply removed and a new stamp wheel with a different arrangement of image projections is mounted on the housing 22.

The stamp wheel 24 and system for mounting this wheel 24 on the housing 22 are or may be conventional, and the present invention may be embodied in stamping systems employing a stamp wheel and wheel retaining system different from the ones just described.

Referring now to FIGS. 3–7, the interoperation of the housing 22, stamp wheel 24, and inking assembly 26 will be now be described in further detail. The bracing portion 54 of the housing 22 defines a bracing surface 80. The exemplary support member 32 is a generally U-shaped member having a base portion 82, first and second engaging portions 84, and first and second arm portions 86 that connect the engaging portions 84 to the base portion 82. Rail portions 88 are formed on each of the arm portions.

When the inking assembly 26 is mounted on the housing 22, the bracing surface 80 engages the base portion 82 to fix the location of the base portion 82 relative to the housing 22. The support member 32 is resiliently deformable such that the engaging portions 84 can move towards and away from the base portion 82.

Figure 6A:
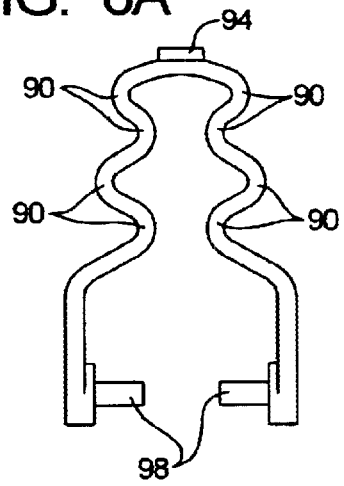
FIG. 6 and 7 are top plan and side elevation views of a support member employed by the inking assembly of FIG. 1.
Figure 6B:
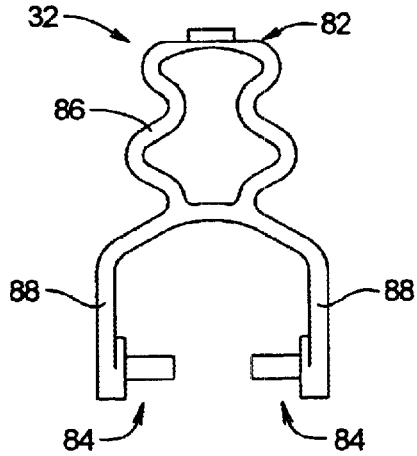
Figure 7:
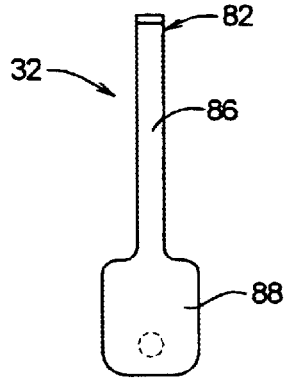
Figure 8A:
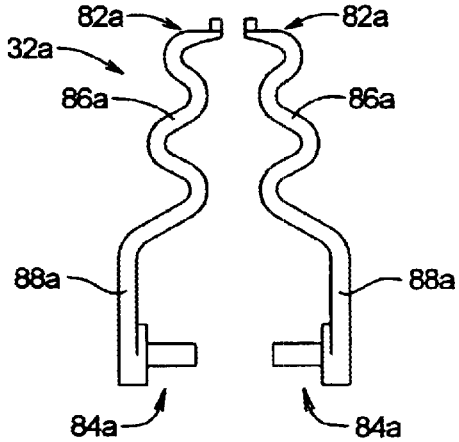
FIGS. 8A–I are top plan views of alternate support members that may be used in place of the support member depicted in FIGS. 6 and 7.
Figure 8B:
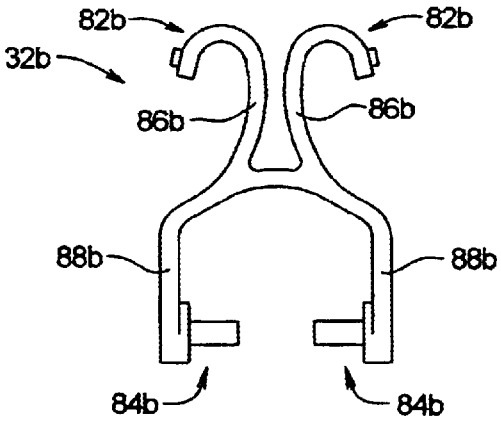
Figure 8C:
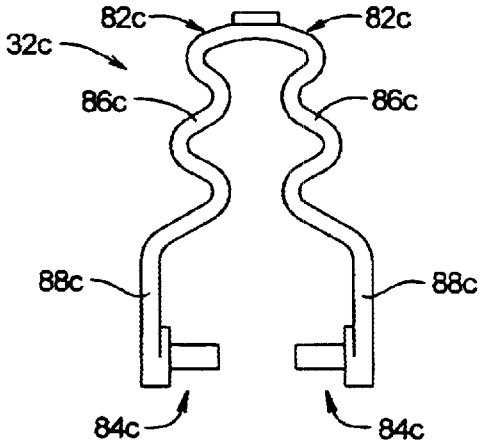
Figure 8D:
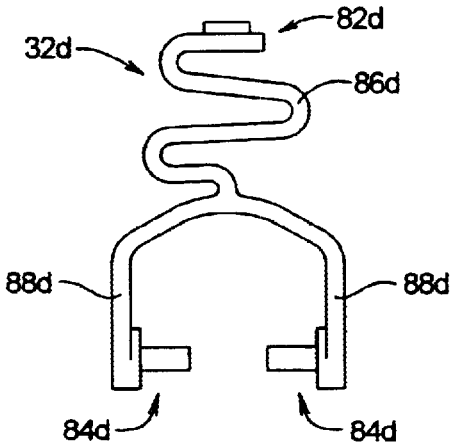
Figure 8E:
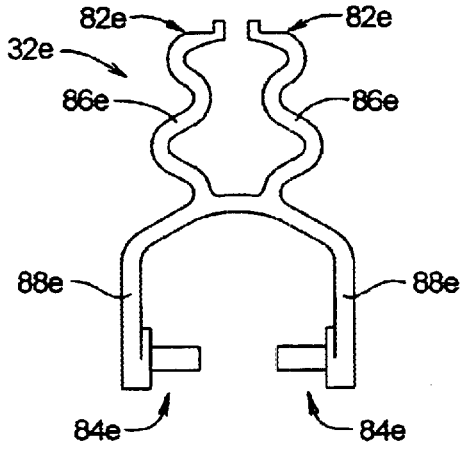
Figure 8F:
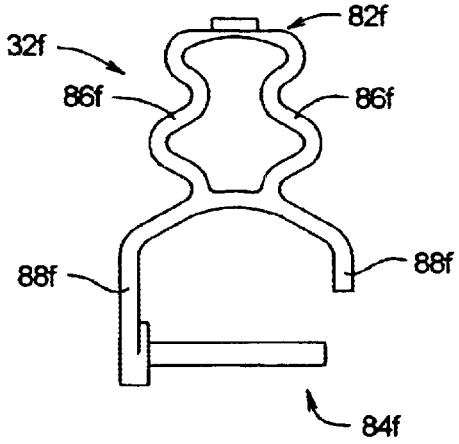
Figure 8G:
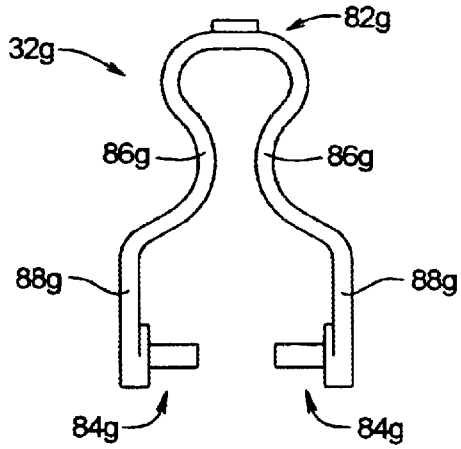
Figure 8H:
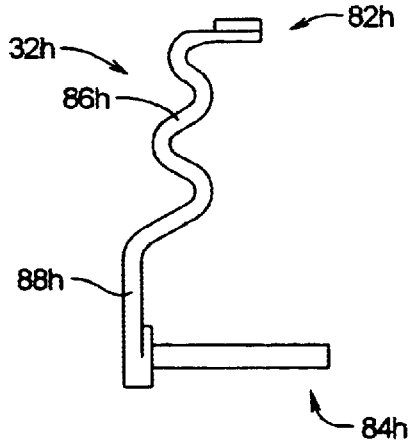
Figure 8I:
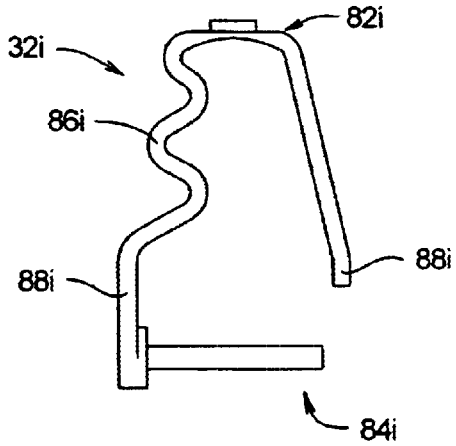

In particular, as best shown in FIG. 6, the arm portions 86 are elongate members having several bends 90 formed therein. The exemplary support member 32 is made of plastic, and the combination of the bends 90 and the plastic material allow the arm portions 86 to provide resiliency to the support member 32 as described above. The deformation of the support member 32 can be seen by comparing FIGS. 6A and 6B.

The rail portions 88 are formed by thickened portions of the arm portions 86. The guide portion 56 of the housing 22 comprises two pairs of upper and lower guide surfaces 92 arranged on either side of the housing 22 to engage the rail portions 88. When the inking assembly 26 is mounted on the housing 22, the guide surfaces 92 engage the rail portions 88 to guide the inking member 30 for limited movement along a guide path D. The exemplary support member 32 further comprises a locating projection 94 that engages a locating depression 96 in the bracing surface 80 to ensure that the rail portions 88 are properly aligned with the guide surfaces 92.

The engaging portions 84 each comprise inwardly extending axle members 98. The axle members 98 define an inking member axis E that is aligned with the longitudinal axis of the inking member 30. The axle members 98 extend into the axle cavities 36 formed in the inking member 30. The axle cavities 36 are aligned along the longitudinal axis of the inking member 30 such that the inking member 30 symmetrically rotates about the inking member axis E.

During use, the inking surface 34 of the inking member 30 engages the stamp surface 76 of the stamp member 72 to transfer ink to the image projections 78. As the ink is transferred to the stamp member 72, the inking member rotates about the inking member axis E such that ink is uniformly applied from the inking member 30.

The engaging portion of the support member 32 may be adapted to engage an inking member of a different shape. For example, the inking member can be in the shape of a solid rectangle, and the engaging portion may be a housing adapted to contain the rectangular inking member and hold this inking member against the stamp wheel 24.

Referring now to FIGS. 8A–I, depicted therein are a number of different support members 32; each of these support members has at least one base portion 82, at least one engaging portions 84, and at least one arm portion 86 that connects the engaging portion(s) 84 to the base portion(s) 82. FIGS. 8A–I illustrate that the principles of the present invention can be implemented with support members of many different configurations.

The stamping system 20 is used in the following manner. The first time the system 20 is used, the housing 22 is assembled and no stamp wheel 24 or inking assembly 26 are mounted thereon. An inking member 30 having ink of a desired color or combination of colors is selected. The selected inking member 30 is then attached to the support member 32 using the engaging portions 84 to form a selected inking assembly 26.

The selected inking assembly 26 is then inserted into the housing 22 such that the base portion 82 of the support member 32 engages the bracing surface 80. The optional locating projection 94 will engage the locating depression 96. In addition, the guide surfaces 92 will engage the rail portions 88 to guide movement of the inking member 30.

The stamp wheel 24 is then placed at least partly into the housing 22 such that the slots 64 in the housing side walls 62 received the axle projections 74 extending from the hub member 70. By firmly pressing the stamp wheel 24, the axle projections 74 will pass through the throat portions 66 and the stamp wheel 24 will be locked onto the housing 22.

At the same time, the stamp surface 76 will engage the inking surface 34 on the inking member 30 and force the inking member 30 towards the bracing surface 80. The engaging portions 84 of the support member 32 will thus move towards the base portion 82, thereby deforming the arm portions 86 and compressing the support member 32. The support member 32 thus biases or forces the inking member 30 against the stamp wheel 24. Ink is thus transferred from the inking member 30 to the stamp surface 76 of the stamp member 72 as the stamp member 72 rotates about the stamp member axis C. In addition, the stamp member 72 frictionally engages and rotates the inking member 30 about the inking member axis E, causing ink to be transferred from the entire inking surface 34.

If a new image is desired, the stamp wheel 24 is removed against the forces of the throat portions 66 and replaced with a new stamp wheel 24. If a new ink color is desired, the stamp wheel 24 is first removed, the inking assembly 26 with the inking member 30 with the old color is then removed, and a new inking assembly 26 comprising an inking member 30 impregnated with a new color is inserted into the housing 22 as described above. The desired stamp wheel 24 is then attached to the housing 22 as described above.

The stamping system 20 of the present invention is easily and inexpensively manufactured of injected molded parts. In particular, aside from the stamp wheel 24 and inking member 30, only three such injection-molded parts are used by the stamping system of the present invention. The stamp wheel 24 and inking member 30 are also simple, but, depending upon the use of the system 20, a number of stamp wheels and inking members may be employed to obtain a desired variety of ink impressions and colors.

From the foregoing, it should be apparent that the present invention may be embodied in many different combinations and sub-combinations of the elements and steps described above. The scope of the present invention should thus be determined by the following claims and not the foregoing detailed description.

I claim:

1. A stamping system for forming ink impressions on a stamping surface of a sheet of material, the system comprising:

a housing defining a handle portion, a wheel retaining portion, a bracing portion, and at least one guide portion;

a stamping wheel, where the stamping wheel is rotatably supported by the wheel retaining portion of the housing; and an inking assembly comprising an inking member, and a support member comprising a single part and defining at least one arm portion, where the inking member is supported by the support member and the support member is braced by the bracing portion, where the at least one arm portion of the support member is resiliently deformable; wherein the at least one arm portion of the support member engages the at least one guide portion of the housing to guide movement of the inking member along an inking path towards the stamping wheel;

when the at least one arm portion of the support member is deformed, the support member forces the inking member against the stamping wheel to apply ink to the stamping wheel; and when the stamping wheel is brought into contact with the stamping surface and the housing is displaced relative to the sheet of material, ink is deposited on the stamping surface to form the ink impression.

2. A stamping system as recited in claim 1, in which the at least one arm portion deforms to allow a shape of the support member to change be one of an extended configuration and a compressed configuration.

3. A stamping system as recited in claim 1, in which the support member further comprises a base portion and an engaging portion, where the engaging portion engages and supports the inking member and the at least one arm portion is arranged between the base portion and the engaging portion.

4. A stamping system as recited in claim 1, in which the guide portion guides the inking member for movement between a retracted position and an extended position.

5. A stamping system as recited in claim 1, in which the guide portion comprises at least one guide surface that engages the at least one arm portion of the support member to guide the inking member.

6. A stamping system as recited in claim 1, in which:

the support member comprises at least one rail portion; and the guide portion of the housing comprises first and second guide surfaces that engage the at least one rail portion of the support member.

7. A stamping system as recited in claim 1, in which the support member comprises a single part having at least one engaging portion that engages and supports the inking at least one rail portion that engages the guide portion of the housing;

at least one base portion that engages the bracing portion of the housing, where the at least one arm portion is arranged between the engaging portion and the base portion; whereby the rail portion acts on the guide portion of the housing to allow the inking member to move along the inking path; and the arm portion resiliently deforms to force the inking member against the stamping wheel.

8. A stamping system as recited in claim 1, in which support member comprises a base portion and an engaging portion, where the engaging portion engages the inking member to support the inking member against the stamping wheel.

9. A stamping system as recited in claim 8, in which the at least one arm portion is arranged between the base portion and the engaging portion.

10. A stamping system as recited in claim 1, in which the support member defines first and second engaging portions arranged to engage first and second portions of the inking member.

11. A stamping system as recited in claim 10, in which the wheel retaining portion of the housing comprises first and second bearing surfaces arranged to engage first and second portions of the stamping wheel to allow the stamping wheel to rotate.

12. A stamping system as recited in claim 1, in which the support member comprises at least one engaging portion that engages the inking member and at least one base portion that engages the bracing portion of the housing, where the at least one arm portion is arranged between the engaging portion and the base portion and the arm portion resiliently deforms to allow an effective distance between the engaging portion and the base portion to be changed.

13. A stamping system as recited in claim 12, in which the support member comprises first and second engaging portions and first and second arm portions.

14. A stamping system as recited in claim 1, in which:

the inking member is a wheel that defines an inking member axis; and the support member comprises a base portion and an axle portion; wherein the axle portion supports the inking member for rotation about the inking member axis.

15. A stamping system as recited in claim 14, in which:

the wheel retaining portion of the housing engages the stamping wheel to allow the stamping wheel to rotate about a stamping wheel axis;

the inking member is a wheel; and the support member comprises a base portion and an axle portion; wherein the axle portion supports the inking member for rotation about an inking member axis; and the inking member axis is substantially parallel to the stamping wheel axis.

16. A method of forming ink impressions on a stamping surface of a sheet of material, the method comprising the steps of:

providing a stamping wheel for forming an ink impression;

providing a housing defining a guide portion;

supporting the stamping wheel on the housing;

providing an inking member;

providing a support member comprising a single part defining a base portion, at least one engaging portion, and at least one resilient arm portion arranged between the base portion and the at least one engaging portion;

forming an inking assembly by mounting the inking member on the engaging portion of the support member;

mounting the inking assembly on the housing such that the at least one arm portion of the support member engages the guide portion of the housing to guide movement of the inking member along an inking path towards the stamping wheel, and the at least one arm portion of the support member compresses to force the inking member against the stamping wheel such that the inking member applies ink to the stamping wheel;

bringing the stamping wheel into contact with the stamping surface; and displacing the housing relative to the sheet of material to roll the stamping wheel along and thereby deposit ink onto the stamping surface to form the ink impression.

17. A method as recited in claim 16, further comprising the step of forming a base portion and at least one engaging portion on the support member, where the at least one arm portion is arranged between the base portion and the at least one engaging portion, in which:

the step of forming the inking assembly comprises the step of supporting the inking member on the engaging portion;

the step of mounting the inking assembly on the housing comprises the step of supporting the base portion against the housing such that the arm portion is deformed to bias the inking member against the stamping wheel.

18. A method as recited in claim 16, further comprising the step of arranging the inking assembly such that the guide portion guides the inking member for movement along the inking path between retracted and extended positions.

19. A method as recited in claim 18, further comprising the steps of forming at least one rail portion on the support member, in which the step of mounting the inking assembly on the housing comprises the step of engaging the rail portion on the support member with the guide portion on the housing.

* * * * *